US009672972B2

(12) United States Patent
Takiguchi et al.

(10) Patent No.: US 9,672,972 B2
(45) Date of Patent: Jun. 6, 2017

(54) WINDING COMPONENT

(71) Applicant: FDK CORPORATION, Tokyo (JP)

(72) Inventors: Takashi Takiguchi, Tokyo (JP); Masami Miyamoto, Tokyo (JP)

(73) Assignee: FDK Corporation, Tokyo (JP)

( * ) Notice: Subject to any disclaimer, the term of this patent is extended or adjusted under 35 U.S.C. 154(b) by 14 days.

(21) Appl. No.: 14/771,711

(22) PCT Filed: Jan. 16, 2014

(86) PCT No.: PCT/JP2014/000190
§ 371 (c)(1),
(2) Date: Aug. 31, 2015

(87) PCT Pub. No.: WO2014/155905
PCT Pub. Date: Oct. 2, 2014

(65) Prior Publication Data

US 2015/0380156 A1 Dec. 31, 2015

(30) Foreign Application Priority Data

Mar. 28, 2013 (JP) ..... 2013-069327

(51) Int. Cl.
*H01F 27/30* (2006.01)
*H01F 27/32* (2006.01)
(Continued)

(52) U.S. Cl.
CPC ..... *H01F 27/325* (2013.01); *H01F 27/2828* (2013.01); *H01F 27/324* (2013.01); *H01F 27/29* (2013.01)

(58) Field of Classification Search
CPC ..... H01F 27/325; H01F 6/06; H01F 41/10
(Continued)

(56) References Cited

U.S. PATENT DOCUMENTS 1,647,372 A * 11/1927 Pressley ..... H01F 27/263 336/107
3,213,397 A * 10/1965 Broverman ..... H01F 5/02 242/118.4

(Continued)

FOREIGN PATENT DOCUMENTS

| | | |
|---|---|---|
| JP | 55-29228 | 7/1980 |
| JP | 63-3130 | 1/1988 |
| JP | 6-62520 | 9/1994 |

OTHER PUBLICATIONS

International Search Report issued Apr. 15, 2014 in International (PCT) Application No. PCT/JP2014/000190, with English translation.

*Primary Examiner* — Alexander Talpalatski
*Assistant Examiner* — Joselito Baisa
(74) *Attorney, Agent, or Firm* — Wenderoth, Lind & Ponack, L.L.P.

(57) ABSTRACT

A winding component includes a core that surrounds an outer circumference of a coil and end surfaces of flanges to form a closed magnetic circuit, in which notches through which end portions of the coil are drawn outward are so formed in the flanges that each of the notches extends radially inward from an outer circumferential edge of the corresponding flange, a wall that surrounds each of the notches such that the wall stands axially outward on the flange, a thick portion in a winding part in correspondence with the notches and thicker than other portions of the winding part, and a lid formed of a sidewall between an outer circumferential surface of the wall and the core and covers the outer circumferential surface of the wall and a top plate at an axially outer end of the sidewall and covers an opening in the wall.

3 Claims, 6 Drawing Sheets

(51) Int. Cl.
*H01F 27/28* (2006.01)
*H01F 27/29* (2006.01)

(58) Field of Classification Search
USPC ..... 336/198
See application file for complete search history.

(56) References Cited

U.S. PATENT DOCUMENTS 3,259,864 A * 7/1966 Marzolf ..... H01F 5/04 336/192
3,363,210 A * 1/1968 Hollyday ..... H01F 5/02 242/118
3,371,302 A * 2/1968 Mas ..... H01F 27/40 336/192
3,461,413 A * 8/1969 Wood ..... H01F 5/04 174/371
3,553,621 A * 1/1971 Lane ..... H01F 5/04 310/194
3,800,172 A * 3/1974 Artin ..... B26B 19/282 310/50
4,010,435 A * 3/1977 Shigehara ..... H01F 5/04 336/192
4,347,493 A * 8/1982 Adams ..... H01F 5/04 310/194
4,394,637 A * 7/1983 Petroons ..... H01F 5/04 336/192
4,520,288 A * 5/1985 Santi ..... H01F 5/02 310/153
4,546,340 A * 10/1985 Kuchuris ..... H01F 27/29 336/192
4,626,813 A * 12/1986 Koga ..... H01F 7/1646 335/202
4,672,348 A * 6/1987 Duve ..... H01F 5/04 336/192
4,880,182 A * 11/1989 Gelfman ..... B65H 75/18 242/118.4
4,890,085 A * 12/1989 Saito ..... H01F 27/29 336/192
4,945,328 A * 7/1990 Kinney ..... H01H 50/443 335/131
5,081,383 A * 1/1992 Kusumoto ..... H02K 3/24 310/194
5,270,604 A * 12/1993 Sandel ..... H02K 1/243 310/194
5,424,691 A * 6/1995 Sadinsky ..... H01F 21/08 333/17.3
5,999,079 A * 12/1999 Wille ..... H01F 41/10 336/192
6,876,287 B2 * 4/2005 Matsuura ..... G01D 5/2086 336/192
7,026,739 B2 * 4/2006 Okada ..... H02K 3/522 310/194
2002/0175798 A1 11/2002 Sigl

* cited by examiner

WINDING COMPONENT

TECHNICAL FIELD

The present invention relates to a winding component used in an electronic circuit and serving as a choke coil, a transformer, or any other component formed of a core and a coil wound around the outer circumference of the core.

BACKGROUND ART

Examples of the winding component of related art include a power transformer used in an electric automobile, a large-sized server, and other apparatus and a transformer and a choke coil used in a DC-DC converter.

In general, when the winding component described above is used to carry current of a large magnitude, copper loss occurs in a wire material of which the coil is made and causes a concern about thermal runaway of a ferrite core and degradation in heat resistance of surrounding materials, possibly resulting in a difficulty in thermal formation of the transformer. To avoid the problem, for example, the diameter of an electric wire that forms the coil is increased to lower the electrical resistance so that no copper loss occurs.

To wind an electric wire around the outer circumference of a core, and when a core 25 is, for example, an E-type core, the mid-leg of the core 25 is inserted into a bobbin 21, which is made of an insulating material, and an electric wire t, such as a copper wire, is wound around a tubular winding part 21*a* of the bobbin 21 to form a coil 23, as shown in FIG. 4. The bobbin 21 needs to ensure insulation between the core 25 and the electric wire t because lead wires 24 are drawn outward through notches 22, which are formed in flanges 21*b*. Further, to attach a winding component 20 to an enclosure, insulation between the lead wires 24, which are drawn from the coil 23 wound around the bobbin 21, and the enclosure needs to be ensured.

To this end, for example, the following methods of related art have been proposed: a method for providing a wall 26 between the notches 22 formed in the flanges 21*b* of the bobbin 21 and the core 25 and drawing the lead wires 24 with the lead wires 24 separated from the wall 26 by a longest possible distance, as shown in FIG. 4A; a method for covering each of the notches 22 formed in the flanges 21*b* of the bobbin 21 with a resin 27, as shown in FIG. 4B; and a method for putting an insulating tube 28 over each of the lead wires 24, as shown in FIG. 4C.

When the winding component 20 is used to carry current of a large magnitude, however, particularly when current of a large magnitude ranging from 10 to 30 A or higher flows, the thickness of the electric wire needs to be increased to suppress copper loss. For example, when a litz wire formed of a large number of twisted wires, is used, the final wire diameter ranges from 2 to 3 mm. Therefore, in the method of related art shown in FIG. 4A for providing the wall 26 between the notches 22 formed in the flanges 21*b* of the bobbin 21 and the core 25 and drawing the lead wires 24 with the lead wires 24 separated from the wall 26 by a longest possible distance, each of the lead wires 24 has a large bending radius, and the core 25 and the lead wire 24 cannot desirably be separated from each other by a sufficiently large creepage distance.

In the method of related art shown in FIG. 4B for covering each of the notches 22 formed in the flanges 21*b* of the bobbin 21 with the resin 27, when the resin 27 covers each of the notches 22, size limitation is imposed from general implementation reasons. A sufficiently large space that accommodates a thick electric wire cannot therefore be provided. In the wire winding process, for example, the lead wires 24 lift up or disengage from the bobbin 21, which means that the operability and product quality are undesirably compromised.

It is conceivable that a fixture or any other tool is used to hold the lead wires 24 drawn through the notches 22 formed in the flanges 21*b* before the wire winding operation is performed. However, the portion where each of the notches 22 is covered with the resin 27 is typically narrow, and it is difficult to provide a space that accommodates the fixture. Further, when the winding component 20 is directly disposed in the enclosure, the insulating distance between the lead wire 24 that is drawn downward and the enclosure is undesirably insufficient.

When high withstand voltage is required between the core 25 and the coil 23, for example, when a withstand voltage of AC 2000 V is required, the winding component is so typically designed and manufactured that a creepage distance of at least several millimeters between the lead wires 24 and the core 25 is ensured. Further, when the winding component 20 is required to comply with a safety standard, it is necessary to provide a large creepage distance between the lead wires 24 and the core 25. For example, creepage distances required by a variety of standards in a case where the operating voltage is 400 V are shown in the following Table 1. Table 1 shows safety standards required for a winding component operating at a voltage of 400 V.

TABLE 1

| Operating voltage | Creepage distance | Safety standard |
|---|---|---|
| 400 V | 2.8 mm or greater | IEC 60664, basic insulation, degree of contamination 2, material group II |
| | 5.6 mm or greater | IEC 60664, reinforced insulation, degree of contamination 2, material group II |
| | 6.4 mm or greater | UL2202 |

As described above, in the winding component 20 that requires high withstand voltage between the core 25 and the coil 23, the method for putting the insulating tube 28 over each of the lead wires 24 has been used, as shown in FIG. 4C. In this method of related prior art, the lead wires 24 are drawn through the notches 22 formed in the flanges 21*b* of the bobbin 21 with the insulating tube 28 put over each of the lead wires 24.

In the winding component 20 that carries current of a large magnitude, however, since the electric wire t itself becomes thick, operation of putting the insulating tube 28 over the electric wire t is time-consuming operation, and an insulating tube 28 that satisfies reinforce insulation is expensive, undesirably resulting in an increase in manufacturing cost.

Further, since the insulating tube 28 itself also becomes thick, and winding the insulating tube 28 along with the coil 23 thickens the wound coil 23, which makes it difficult to bend the lead wires 24 drawn through the notches 22, resulting in a problem of restriction of the flexibility in routing the lead wires.

SUMMARY OF INVENTION

Technical Problem

The present invention has been made in view of the circumstances described above, and an object of the invention is to provide a winding component that ensures insulation between lead wires from a coil formed of a large-diameter electric wire that carries current of a large magnitude and a core and readily allows operation of winding the electric wire.

Solution to Problem

To achieve the object described above, a winding component of the present invention comprises: a bobbin having flanges formed at axially opposite ends of a tubular winding part; a coil wound around the winding part of the bobbin; and a core that surrounds an outer circumference of the coil and end surfaces of the flanges to form a closed magnetic circuit, wherein notches through which end portions of the coil are drawn outward are so formed in the flanges that each of the notches extends radially inward from an outer circumferential edge of the corresponding flange, a wall that surrounds each of the notches is so provided that the wall stands axially outward on the flange, a thick portion is formed in the winding part in correspondence with the notches and is made thicker than other portions of the winding part, and a lid formed of a sidewall that is disposed between an outer circumferential surface of the wall and the core and covers the outer circumferential surface of the wall, and a top plate that is formed at an axially outer end of the sidewall and covers an opening in the wall is provided.

According to another aspect of the invention, each of the lids is so configured that the sidewall has a continuous ring shape and the top plate is formed at the axially outer end of the sidewall.

Advantageous Effects of Invention

The walls, which surround the notches, which are formed in the flanges of the bobbin and through which end portions of the coil are drawn, stand on the flanges axially outward, and the lids, which cover the outer circumferential surfaces and the openings of the walls, are provided, and the lids are put on the walls after an electric wire is wound around the winding part of the bobbin. Therefore, even when the coil is formed of a large-diameter electric wire, the winding operation described above can be readily performed with no winding failure and improvement in product quality.

Further, since the thick portion, which is thicker than the other portions of the winding part, is formed in correspondence with the notches formed in the flanges, the lids, each of which is formed of the sidewall, which is disposed between the outer circumferential surface of the corresponding wall and the core and covers the outer circumferential surface of the wall, and the top plate, which covers the opening of the wall, can be provided, whereby a creepage distance from the core to the end portions of the coil can be ensured without integration of the walls with the lids. As a result, insulation between the core and the end portions of the coil can be ensured.

Since the thick portion is formed in part of the winding part, an increase in the winding length of the coil wound around the winding part can be suppressed. As a result, copper loss associated with an increase in the winding length of the coil and an increase in manufacturing cost can be suppressed.

According to the invention described in claim 2, since each of the lids is so formed that the sidewall has a continuous ring shape and the top plate is formed at the axially outer end of the sidewall, the end portions of the coil that are drawn through the notches are bent axially inward by the sidewalls. Therefore, when the winding component is attached, for example, to an enclosure, a long creepage distance between the enclosure and the lead wires can be created. As a result, insulation between the enclosure and the lead wires can be ensured.

DESCRIPTION OF EMBODIMENTS

Figure 1A:
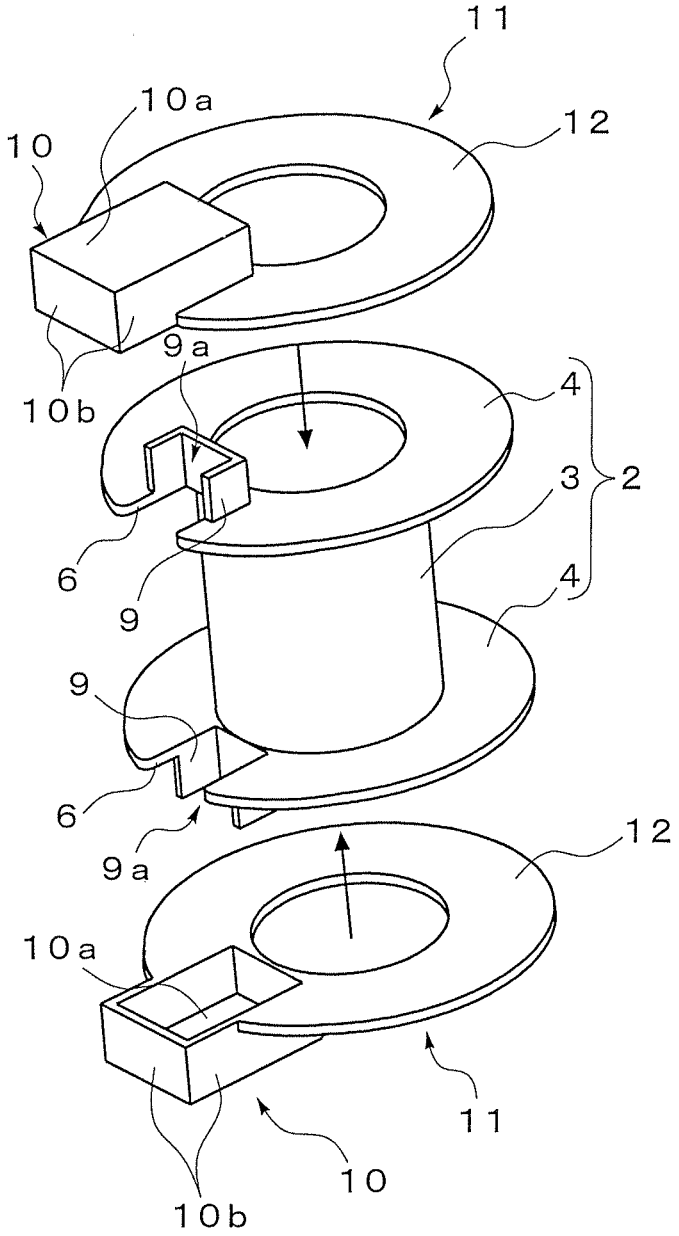
FIG. 1A shows a winding component according to an embodiment of the present invention and is an exploded perspective view of a bobbin and lids.
Figure 1B:
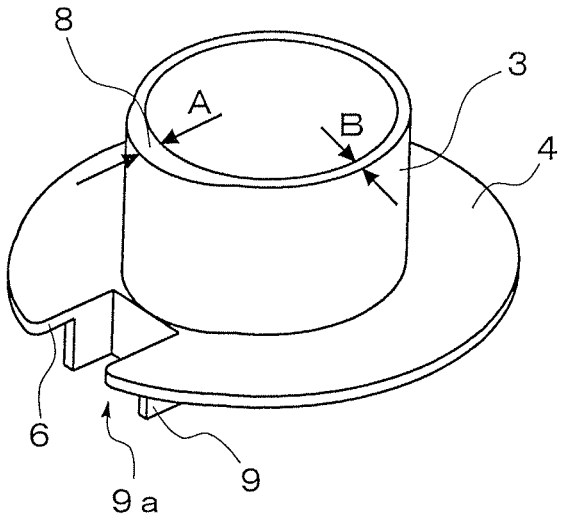
FIG. 1B shows the winding component according to the embodiment of the present invention and is a perspective view showing the winding part taken in the radial direction.
Figure 1C:
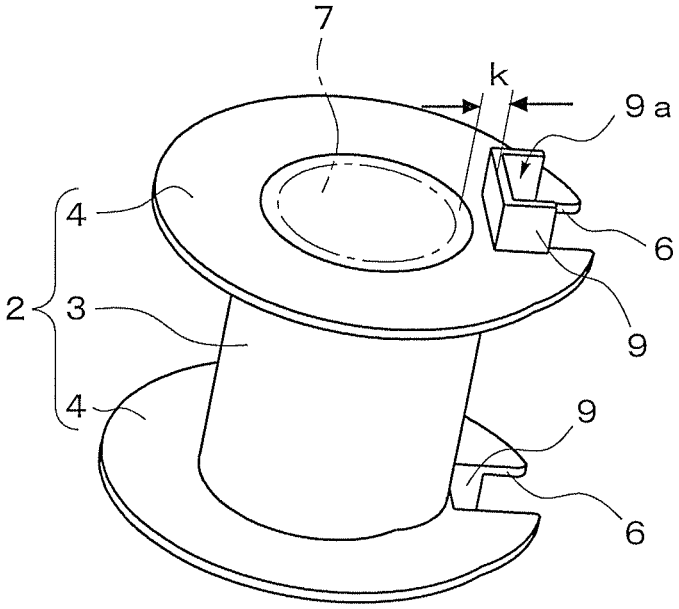
FIG. 1C shows the winding component according to the embodiment of the present invention and is a perspective view of the bobbin.
Figure 2:
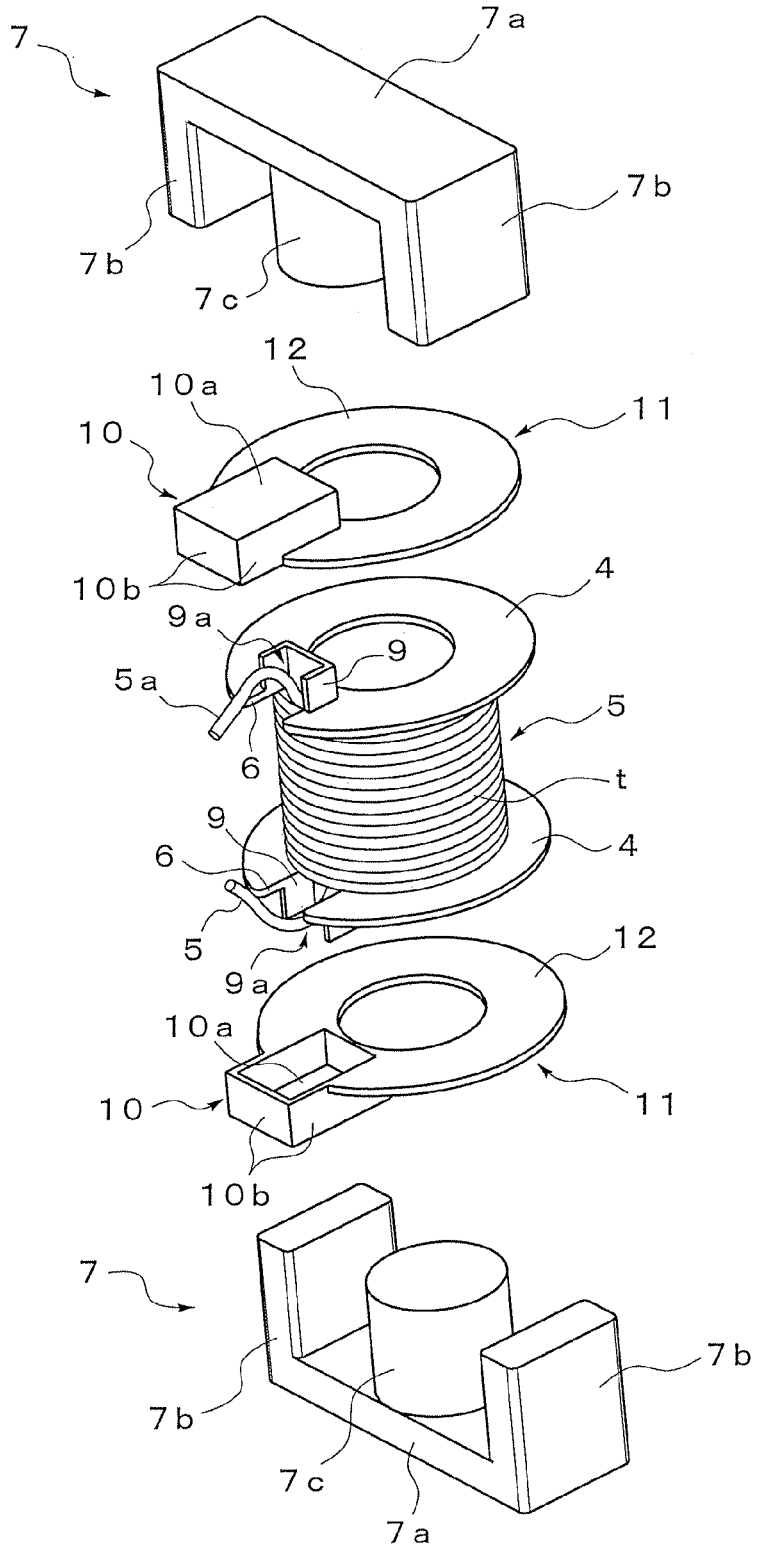
FIG. 2 is an exploded perspective view of the winding component according to the embodiment of the present invention.
Figure 3A:
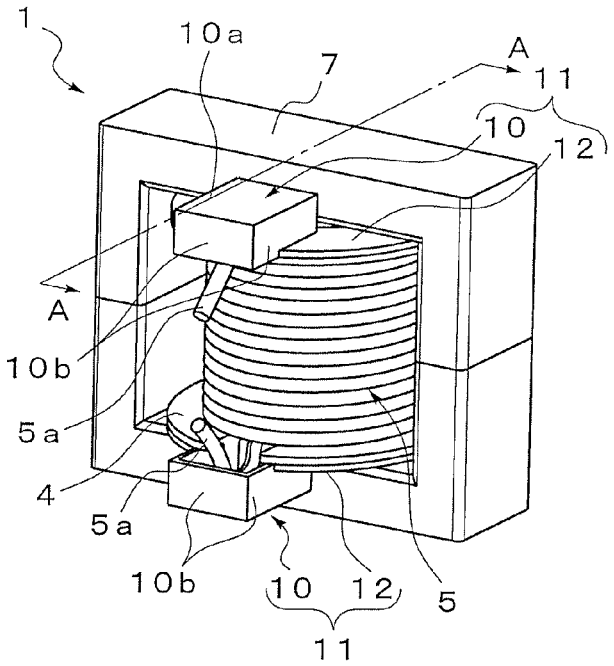
FIG. 3A shows the assembled and completed winding component according to the embodiment of the present invention.

FIGS. 1 to 3 show an embodiment of a winding member according to the present invention, and a winding component 1 generally includes a bobbin 2, which has flanges 4 formed on axially opposite ends of a cylindrical (tubular) winding part 3, a coil 5, which is wound around the winding part 3 of the bobbin 2, and a core 7, which surrounds the outer circumference of the coil 5 and end surfaces of the flanges to form a closed magnetic circuit.

The bobbin 2 is formed of an insulating member, for example, is made of a synthesized resin. A notch 6, through which a lead wire (end portion) 5*a* of the coil 5 is drawn outward, is formed in each of the flanges 4. Each of the notches 6 is so formed that the notch extends radially inward from the outer circumferential edge of the corresponding flange 4 and concavely opens in a plan view.

On each of the flanges 4, a wall 9, which surrounds the notch 6, is so provided that it stands axially outward. The wall 9 stands along the closed-side edge of the notch 6, extends along edge portions of the notch 6 on opposite sides in the circumferential direction of the flange 4 from the closed side to a position of roughly half the length of the notch, and has a U-like shape in a plan view.

Part of the winding part 3 of the bobbin 2 is a thick portion 8 formed in correspondence with the notches 6 formed in the flanges 4. The thick portion 8 has a thickness A greater than a thickness B of the other portions of the winding part 3, and an egg-like shape is formed in a cross section of the winding part 3 taken along the radial direction thereof, as shown in FIG. 1B. The thick portion 8 ensures a distance k between the wall 9 and the core 7, as shown in FIG. 1C.

Further, the coil 5 is so wound around the winding part 3, for example, that a litz wire t is introduced from the outside of the bobbin 2 through the notch 6 formed as an opening in one of the flanges 4 of the bobbin 2 to the winding part 3, wound around the winding part 3, and then drawn through the notch 6 out of the other flange 4.

Cap members 11 are disposed on the outer side of the flanges 4 formed at opposite ends of the bobbin 2. Each of the cap members 11 includes a lid 10, which covers the wall 9 that stands on the corresponding flange 4, and a donut-disk-shaped support 12, which supports the lid 10, through which the core 7 is inserted and which comes into contact with the end surface of the flange 4.

The lid 10 includes a sidewall 10*b*, which is disposed between the outer circumferential surface of the corresponding wall 9 and the core 7 and covers the outer circumferential surface of the wall 9, and a top plate 10*a*, which is formed at the axially outer end of the sidewall 10*b* and covers the opening of the wall 9. The sidewall 10*b* has an angled ring shape and is integrated with the outer circumferential edge of the top plate 10*a*, which is formed in a rectangular shape in a plan view.

The core 7, which surrounds the outer circumference of the coil 5 and the end surfaces of the flanges 4 to form a closed magnetic circuit, is formed of a pair of E-shaped ferrite cores. Each of the E-shaped cores 7 includes a rectangular-plate-shaped back portion 7*a*, roughly plate-shaped outer legs 7*b*, which stand on longitudinal opposite ends of the back portion 7*a*, and a cylindrical middle leg 7*c*, which stands on a middle portion between the outer legs 7*b*.

The middle legs 7*c* of the core 7 are inserted into the bobbin 2 and the supports 12 of the cap members 11, and the outer legs 7*b* and the back portions 7*a* of the core 7 surround the outer circumference of the coil 5 and the end surfaces of the flanges 4 to form a θ-shaped or figure-8 shaped (confronting two E-shapes) closed magnetic circuit.

To assemble the thus configured winding component 1, one end of the litz wire t is first fixed, and the litz wire t is then introduced to the winding part 3 through the notch 6 formed as an opening in one of the flanges 4 of the bobbin 2. The litz wire t is then wound around the winding part 3 and drawn through the notch 6 out of the other flange 4.

The cap members 11 are then disposed on the outer side of the flanges 4 of the bobbin 2, and the lids 10 are put over the walls 9 standing on the flanges 4. In this process, the top plates 10*a* of the lids 10 cover the openings 9*a* of the walls 9, and the sidewalls 10*b* come into contact with and cover the entire outer circumferential surfaces of the walls 9. Further, the ends of the sidewalls 10*b* come into contact with the surfaces of the flanges 4 including the thick portion 8 of the winding part 3.

The middle legs 7*c* of the pair of E-shaped cores 7 are then inserted into the bobbin 2 and the supports 12 of the cap members 11. As a result, the outer legs 7*b* and the back portions 7*a* of the core 7 surround the outer circumference of the coil 5 and the end surfaces of the flanges 4 to form a θ-shaped or figure-8 shaped closed magnetic circuit. In this process, the lids 10 having been put on the walls 9 insulate the lead wires 5*a* drawn through the notches 6 in the flanges 4 from the core 7.

Figure 3B:
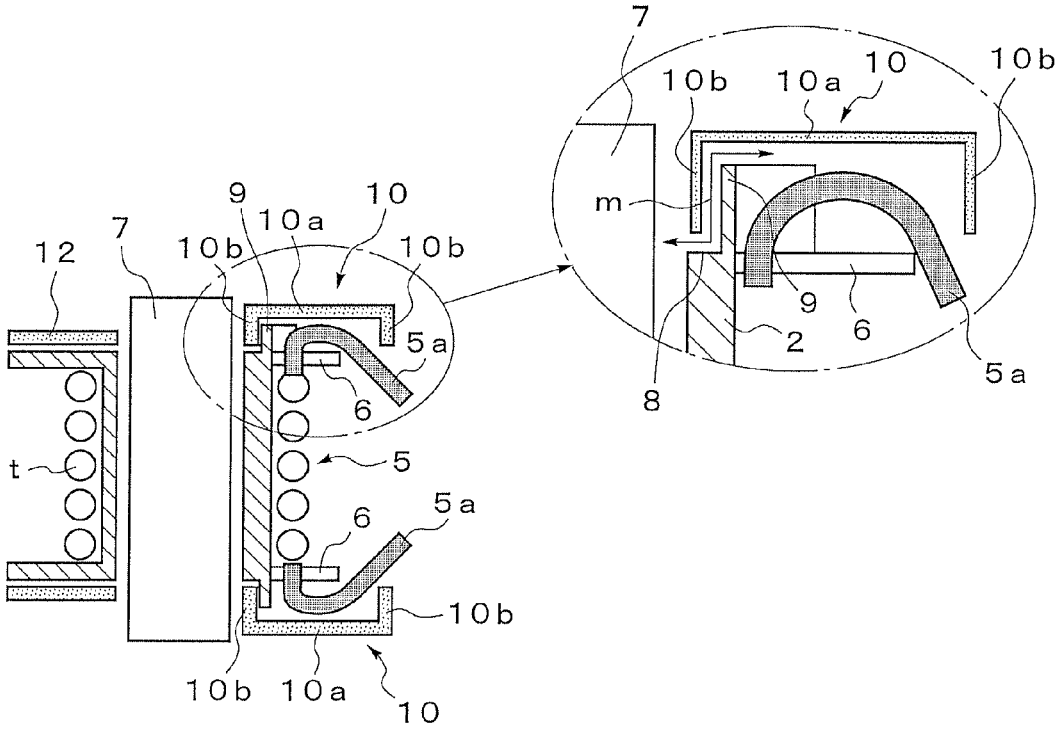
FIG. 3B is a cross-sectional view taken along the line A-A in FIG. 3A and a partially enlarged view.

When the sidewalls 10*b* of the lids 10 are inserted between the core 7 and the walls 9 so that the openings 9*a* of the walls 9 are covered with the top plates 10*a*, the thick portion 8 of the winding part 3 allows creation of a creepage distance m from the middle legs of the core 7 to the lead wires 5*a*, whereby insulation between the middle legs of the core 7 and the lead wires 5*a* is ensured, as shown in the enlarged cross-sectional view of FIG. 3B.

Figure 3C:
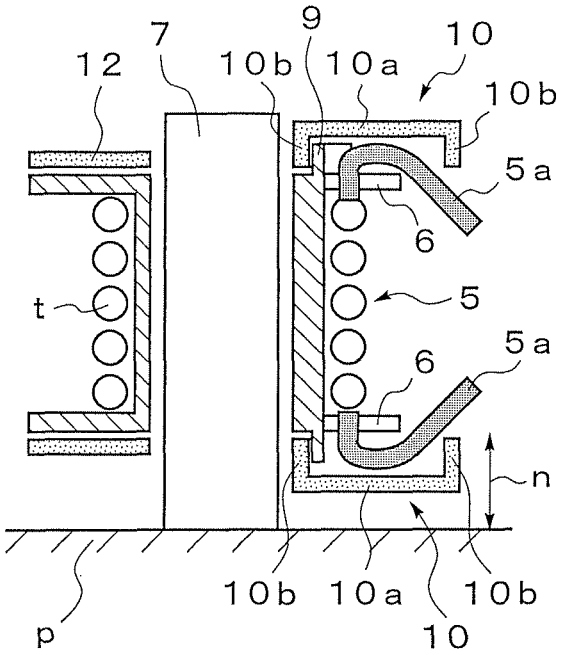
FIG. 3C is a cross-sectional view taken along the line A-A in FIG. 3A with the winding component placed on an enclosure.
Figure 4A:
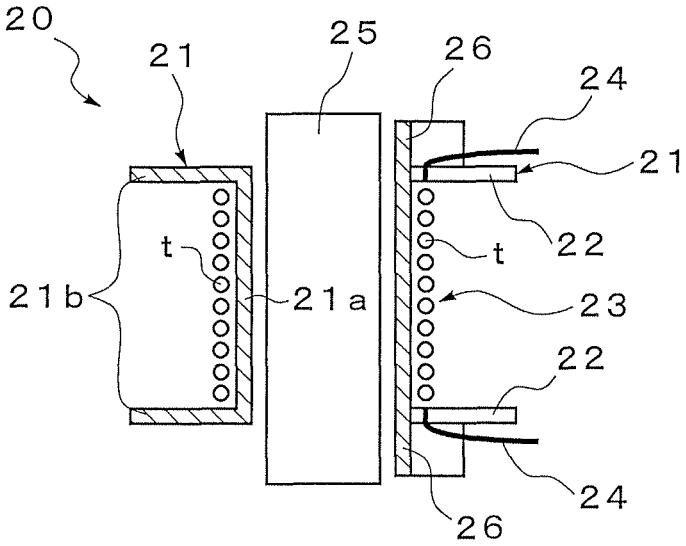
FIG. 4A is a schematic view showing a method for insulating lead wires of a winding component of related art.
Figure 4B:
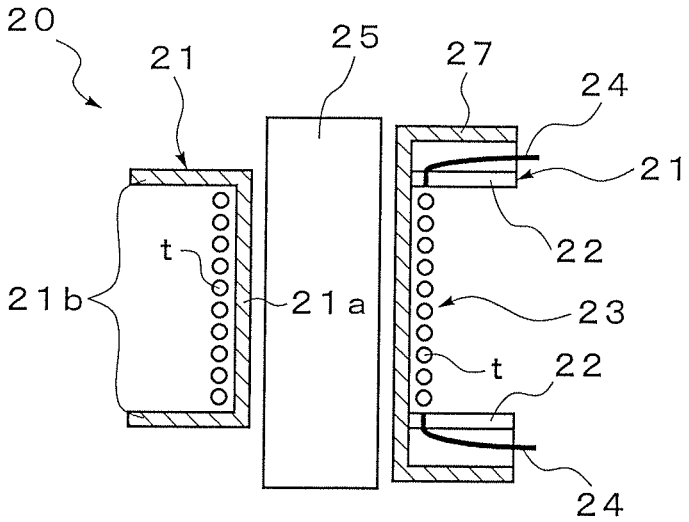
FIG. 4B is a schematic view showing a method for insulating lead wires of a winding component of related art.
Figure 4C:
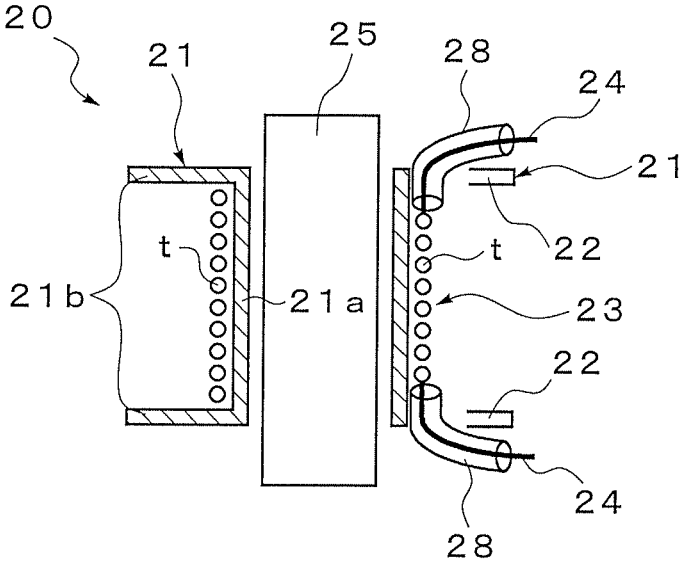
FIG. 4C is a schematic view showing a method for insulating lead wires of a winding component of related art.

Further, the completed winding component 1 is attached to an enclosure p. In this process, as shown in FIG. 3C, the lead wires 5*a* drawn through the notches 6 in the flanges 4 are bent by the sidewalls 10*b*, which are part of the lids 10 and formed in a continuous ring shape, axially inward so that a creepage distance n from the enclosure p to the lead wires 5*a* is created.

According to the thus configured winding component 1, the walls 9, which surround the notches 6, which are formed in the flanges 4 of the bobbin 2 and through which the lead wires 5*a* of the coil 5 are drawn, stand on the flanges 4 axially outward, and the lids 10, which cover the outer circumferential surfaces and the openings 9*a* of the walls 9, are provided, and the lids 10 are put on the walls 9 after the litz wire t is wound around the winding part 3 of the bobbin 2. Therefore, even when the coil 5 is formed of the litz wire t, the winding operation described above can be readily performed with no winding failure and improvement in product quality.

Further, since the thick portion 8, which is thicker than the other portions of the winding part 3, is formed in correspondence with the notches 6 formed in the flanges 4, the lids 10, each of which is formed of the sidewall 10*b*, which is disposed between the outer circumferential surface of the corresponding wall 9 and the core 7 and covers the outer circumferential surface of the wall 9, and the top plate 10*a*, which covers the opening 9*a* of the wall 9, can be provided, so that a creepage distance from the core 7 to the lead wires 5*a* of the coil 5 can be ensured without integration of the walls 9 with the lids 10. As a result, insulation between the core 7 and the lead wires 5*a* of the coil 5 can be ensured.

Since the thick portion 8 is formed in part of the winding part 3, an increase in the winding length of the coil 5 wound around the winding part 3 can be suppressed. As a result, copper loss associated with an increase in the winding length of the coil 5 and an increase in manufacturing cost can be suppressed.

Further, since each of the lids 10 is so formed that the sidewall has a continuous ring shape and the top plate is formed at the axially outer end of the sidewall, the end portions of the coil that are drawn through the notches are bent axially inward by the sidewalls. Therefore, when the winding component is attached, for example, to an enclosure, a long creepage distance between the enclosure and the lead wires can be created. As a result, insulation between the enclosure and the lead wires can be ensured.

In the embodiment described above, the description has been made only of the case where as the thick portion 8, the portion formed in correspondence with the notches 6 formed in the flanges 4 is made thicker than the other portions of the winding part 3, but the present invention is not limited to the case. For example, the winding part 3 may be so formed that it has a uniform thickness, and the wall corresponding to the notches 6 formed in the flanges 4 may be allowed to protrude outward so that an egg-like cross section is achieved. In this case as well, the distance k between the walls 9 and the core 7 can be ensured, as shown in FIG. 1C.

Further, in the embodiment described above, the description has been made only of the case where the electric wire t wound around the winding part 3 of the bobbin 2 to form the coil 5 is formed of the Litz wire t, but the present invention is not limited to the case. A variety of types of electric wire can be used based on the specifications of a choke coil and a transformer.

Further, the description has been made only of the case where each of the pair of cores 7 is formed of an E-shaped core, but the present invention is not limited to the case. An E-shaped ferrite core and an I-shaped ferrite core can be combined with each other.

INDUSTRIAL APPLICABILITY

The present invention is applicable, for example, to a choke coil and a transformer which is implemented, for example, in an electronic apparatus and formed of a core and a coil wound around the outer circumference of the core.

REFERENCE SIGNS LIST

1 Winding component
2 Bobbin
3 Winding part
4 Flange
5 Coil
5*a* lead wire (end portion)
6 Notch
7 Core (core)
8 Thick portion
9 Wall
9*a* Opening
10 Lid
10*a* Top plate
10*b* Sidewall
11 Cap member
12 Support
t Litz wire (electric wire)

The invention claimed is:

1. A winding component comprising:

a bobbin having flanges formed at axially opposite ends of a tubular winding part;

a coil wound around the winding part of the bobbin; and a core that surrounds an outer circumference of the coil and end surfaces of the flanges to form a closed magnetic circuit, wherein the bobbin further includes:

notches through which end portions of the coil are drawn outward so formed in the flanges that each of the notches extends radially inward from an outer circumferential edge of the corresponding flange, a wall that surrounds each of the notches so provided that the wall stands axially outward on each of the flanges, a thick portion formed in the winding part in correspondence with the notches and made thicker than other portions of the winding part, the thick portion having an egg-like shape formed in a cross section of the winding part taken along the radial direction thereof, and a lid formed of a sidewall that is disposed between an outer circumferential surface of the wall and the core and covers an outer circumferential surface of the wall, and a top plate formed at an axially outer end of the sidewall, and covers an opening in the wall.

2. The winding component according to claim 1, wherein the lid is so configured that the sidewall has a continuous ring shape, and the top plate is formed at the axially outer end of the sidewall.

3. The winding component according to claim 1, wherein the core comprises a pair of E-shaped ferrite cores, the pair of E-shaped ferrite cores each having a rectangular-plate-shaped back portion, plate-shaped outer legs standing on longitudinal opposite ends of the back portion, and a cylindrical middle leg standing on a middle portion between the outer legs.

* * * * *